US006478153B1

(12) United States Patent
King

(10) Patent No.: US 6,478,153 B1
(45) Date of Patent: Nov. 12, 2002

(54) PACKAGE FOR FRAMED AND UNFRAMED SINGLE MIRRORS

(76) Inventor: Rudolf C. King, Dachauer Str. 17, 80335 München (DE)

( * ) Notice: Subject to any disclaimer, the term of this patent is extended or adjusted under 35 U.S.C. 154(b) by 0 days.

(21) Appl. No.: 09/532,577

(22) Filed: Mar. 22, 2000

(30) Foreign Application Priority Data

Mar. 23, 1999 (DE) ..... 299 05 325 U

(51) Int. Cl.[7] ..... B65D 85/48; B65D 81/113
(52) U.S. Cl. ..... 206/454; 206/511; 206/593
(58) Field of Search ..... 206/454, 456, 206/591–594, 448, 511; 211/41.14

(56) References Cited

U.S. PATENT DOCUMENTS

| | | | | | |
|---|---|---|---|---|---|
| 1,941,941 | A | * | 1/1934 | Irwin | 206/511 |
| 2,281,657 | A | * | 5/1942 | Agvino | 206/454 |
| 2,589,604 | A | * | 3/1952 | Cunningham | 206/454 |
| 2,861,681 | A | | 11/1958 | Lane | |
| 3,389,786 | A | * | 6/1968 | Lidgard | 206/454 |
| 3,489,765 | A | * | 1/1970 | Puente | 206/454 |
| 3,695,424 | A | | 10/1972 | Cristy et al. | |
| 3,756,393 | A | * | 9/1973 | Markwitz et al. | 206/456 |
| 3,939,978 | A | | 2/1976 | Thomaswick | |
| 4,047,612 | A | * | 9/1977 | Lohmann | 206/454 |
| 4,511,038 | A | * | 4/1985 | Miller et al. | 206/454 |
| 4,583,639 | A | | 4/1986 | Fedick et al. | |
| 5,147,042 | A | * | 9/1992 | Levy | 206/456 |
| 5,292,000 | A | * | 3/1994 | Levy | 206/456 |

FOREIGN PATENT DOCUMENTS

| | | | | |
|---|---|---|---|---|
| DE | 2157567 | * | 6/1972 | 206/454 |

* cited by examiner

*Primary Examiner*—Bryon P. Gehman
(74) *Attorney, Agent, or Firm*—Reising, Ethington, Barnes, Kisselle, Learman & McCulloch, P.C.

(57) ABSTRACT

A package for framed and unframed single mirrors is disclosed. The package includes a recess projecting past the single mirror on all sides and in which the single mirror is to be so received that it is held in a substantially coplanar relation to the face delimiting the recess at the bottom of the package. The recess has dimensions such that there is a clearance between the delimiting edges of the recess and that of the single mirror. The clearance is adapted to allow for possible movement of the single mirror following a blow or impact. The package further includes a counter-abutment member that has a surface for contacting an external face of the mirror to retain the mirror between the recessed face and the counter-abutment member. There is also included a fastening mechanism for use in locating and mounting the counter-abutment member and the single mirror in the recess.

9 Claims, 1 Drawing Sheet

PACKAGE FOR FRAMED AND UNFRAMED SINGLE MIRRORS

TECHNICAL FIELD

The invention relates to a package for framed and unframed single mirrors.

BACKGROUND OF THE INVENTION

Conventional packages only comprise four package elements arranged at the corners of the single mirror, which are connected together. Should the package carton fall to the ground, on tipping of conventional packages and in other circumstances, in which a force is applied, breakage of the pane of glass is likely.

SUMMARY OF THE INVENTION

One object of the invention is therefore to provide a package for single framed and unframed mirrors, which ensures maximum protection for such single mirror in all situations of handling.

In order to achieve these and/or other objects appearing from the present specification, claims and drawings, in the present invention a package for single framed and unframed mirrors comprises a package having a sheet-like recess projecting past the single mirror on all sides and in which the single mirror is to be so received that it is held in substantially coplanar relation to a recessed face delimiting the recess at the bottom, the recess having such dimensions that there is a clearance between the delimiting edges of the recess and the single mirror. This clearance serves to allow for possible compensating movements of the single mirror owing to a blow or impact. Accordingly, the single mirror is supported in a floating manner. The compensatory movements take place in a fashion which is coplanar to the plane of the mirror. This means that the single mirror is not in direct contact with the limiting edges. A counter-abutment member is provided, which is placed on the single mirror and holds and supports the single mirror in its middle (frame-free) region in connection with a fastening mechanism.

Hitherto it has been necessary to design and produce a separate package for each single mirror, which must be adapted to the size, thickness and external shape of the framed or unframed single mirror.

In the present invention this is not necessary. Owing to the clearance of the edge and possibly of the bottom delimiting face from the single mirror one single package will be suitable for a plurality of sizes, thicknesses and external shapes of single mirrors. The clearance serves to protect against breakage and makes the packages uniform. Because one single package is suitable for a plurality of single framed and unframed mirrors, the user has a substantial advantage as regards development, storage and costs.

The package in accordance with the invention, which is preferably manufactured of polystyrene, provides for a means supporting and holding the single mirror on all sides in the recess. With the aid of such counter-abutment member only the fragile glass of the single mirror is clamped in place and held. The glass preferably lies on the floor of the recess, i.e. the recessed face. Any frame of the single mirror does not make contact with the package. Owing to the clamping of the glass face even when the package is subject to a blow the forces will be evenly distributed and will not lead to a one-sided local concentration of load acting on the single mirror face or, respectively, glass face. This means that the single mirror is effectively protected against breakage.

It is preferred for the package that it includes a support member which supports the single mirror in its middle region in relation to the recessed face. The additional support member is only necessary for single mirrors, in case the frame has a greater thickness than the glass of the mirror. This ensures that the single mirror has its middle unframed glass region resting in a planar fashion on the recessed face. Otherwise only the edges of the single mirror would rest on the recessed surface, this being undesired. In the case of a smooth unframed glass surface such a support member is not necessary.

It is preferred to provide knob-like projections on the edge of the package. These knob-like projections are thus outside the recess and mean that there is an additional increase in safety of handling, since they would support the package if it should fall over.

It is preferred for the edges of the package to be rounded. This means that if there is a lateral blow, which is directed toward one corner of the package, the danger of breakage is reduced still further and in the case of unorderly stacking the package may more readily reach a level setting without an elastic bending action thrust having to be transmitted via an edge. The package will roll along in the case of improper stacking and will have less tendency to whip or flip back elastically.

Further advantageous developments and convenient forms of the invention will be understood from the following detailed descriptive disclosure of two embodiments thereof in conjunction with the accompanying drawings.

DETAILED DESCRIPTION OF THE PREFERRED EMBODIMENT

Figure 1C:
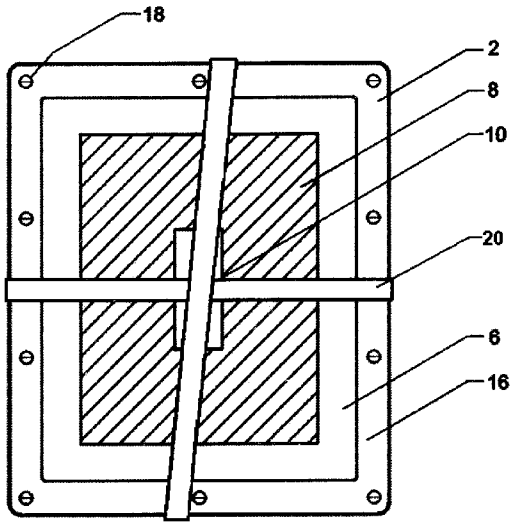
FIGS. 1*a*, 1*b*, and 1*c* show a cross section, a perspective view, and a top view, respectively, of one possible embodiment of a package in accordance with the invention.
Figure 1A:
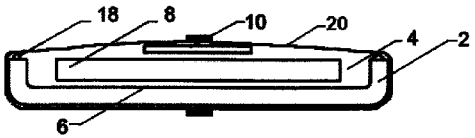
Figure 1B:
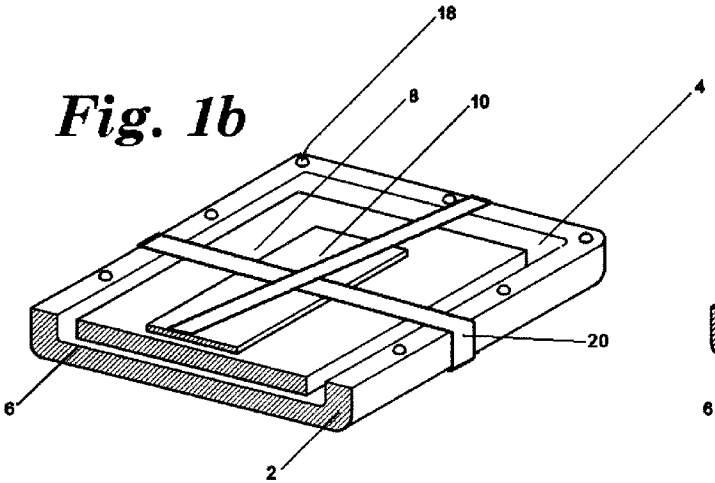

The embodiment illustrated in FIGS. 1*a*–1*c* is characterized by a substantially rectangular package 2 of plastic. In an inner region this package is provided with a recess or well 4, which has a depth of 1 to 10 cm and in its floor region provides a sheet-like planar recessed face 6. The recessed face is so formed that it can receive a commercially available single mirror and project past the frame edge of the single mirror all the way around. An overlap of 3–7, preferably 5–6 cm is sufficient. On the recessed face 6 a single mirror 8 (in this case a frameless single mirror) is placed in such a manner that its mirror face rests in a planar manner on the recessed face. Thus, package 2 operates as a receiving means for receiving the mirror 8. For holding the single mirror a counter-abutment member 10 in the form of a rectangular plate or board is provided, which is placed on a central region of the glass face of the single mirror and is held by a fastening mechanism such as straps or ties 20 on the package 2. The fastening mechanism operates as an attachment means for holding the counter-abutment member 10 against the mirror 8. It is in this manner that the counter-abutment member 10 is thrust against the face of the single mirror and the mirror is therefore thrust against recessed face 6 so that there is an effective support action for the glass face of the single mirror. On the edge, which is not recessed, of the package 2 a plurality of knob-like projections 18 is provided, which serve for providing an additional means for safe handling. The edges of the package are preferably rounded.

Figure 2A:
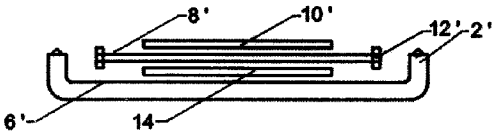
FIGS. 2*a* and 2*b* show respective cross section and perspective views of a further embodiment of a package in accordance with the invention.
Figure 2B:
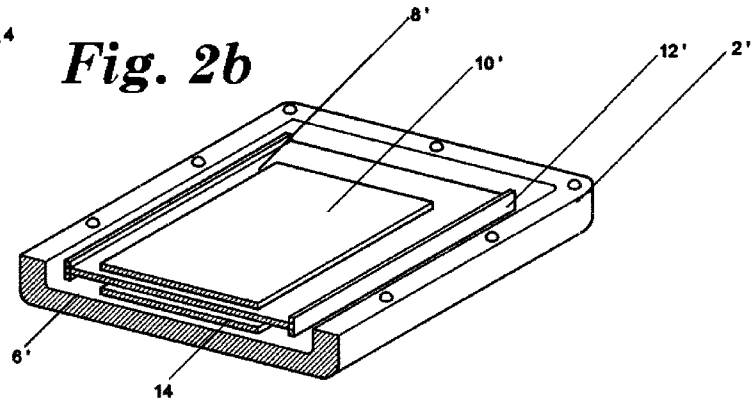

FIGS. 2*a* and 2*b* show a further embodiment of the package in accordance with the invention. In this case in the thickness direction the frame 12' of the single mirror projects past the glass face. As a result, direct engagement of the single mirror on the recessed face 6' is not possible. A support member in the form of a flat platform-like holding means 14 is provided which is introduced between the recessed face 6' and the single mirror 8'. It provides for an effective support of the single mirror in the central unframed region. It is in this manner that there can be indirect engagement of the single mirror 12' on the recessed face 6'.

The package of the invention differs from known commercially available packages by a substantial protection of the packed single mirrors against fracture even in awkward handling situations, for example on impact, on being thrown and on tipping over. A blow is then resiliently deadened and does not lead to a one-sided local intensification of stress on the mirror face. The single mirror face is effectively clamped in place. In the case of a lateral blow, the mirror, which is held and slowed down by the tension of the counter-abutment member 10 and 10' held by the strap, may move in the direction of the blow, something which amounts to a floating suspension. Owing to the retarding action due to the design the mirror may come to a halt, before a corner thereof comes into engagement with a corner or side of the package 2 and 2'.

Historically, it has been necessary to design a single package for each single mirror, which should be designed in accordance with the size, thickness and external shape of the framed and unframed single mirror.

This is unnecessary in the present invention. Owing to the distance of the edge 16 and 16' and the bottom delimiting face 6 and 6' of the single mirror a single package will be able to accommodate a plurality of sizes, thicknesses and external shapes of framed and unframed mirrors. The clearance consequently provides protection against fracture and makes the package uniform. Since only a single package fits a plurality framed and unframed mirrors, the user does have an advantage as regards development, storage and costs.

I claim:

1. A mirror package, comprising:

a package having a recess;

a mirror disposed in said recess, wherein said recess projects past said mirror on all sides, with said mirror being supported centrally by a recessed face delimiting said recess at its bottom, said recess having such dimensions that there is a clearance between the delimiting edges of said recess and said mirror, said clearance being adapted to allow for possible movement of said mirror following a blow or impact;

a counter-abutment member having a surface for contacting an external face of said mirror to thereby retain said mirror between said recessed face and said counter-abutment member; and a fastening mechanism that attaches to said package and said counter-abutment member, with said fastening mechanism being provided for use in locating and mounting said counter-abutment member and said mirror in said recess.

2. A mirror package as set forth in claim 1, further comprising a support member adapted to be received between said mirror and said recessed face to thereby support said mirror in a central region.

3. A mirror package as set forth in claim 1, further comprising a surrounding raised edge region of said package, wherein said raised edge region includes a plurality of projections.

4. A mirror package as set forth in claim 1, wherein said package includes rounded corners.

5. A mirror package as set forth in claim 1, wherein said fastening mechanism comprises straps or ties connected to said package and spanning said recess in contact with said counter-abutment member, wherein said fastening mechanism restricts movement of said counter-abutment member away from said recess to thereby retain said mirror in said recess.

6. A mirror package, comprising:

a package that includes a planar floor and one or more side walls extending upwardly away from said floor to thereby provide a recess that is delimited by said floor and said one or more side walls;

a planar mirror disposed within said recess and having two opposing planar surfaces, with said mirror being supported by said floor across a substantial portion of one of said surfaces, including being supported by said floor in a central region of said mirror, wherein said mirror is smaller than said recess such that a clearance exists between said mirror and at least one of said one or more side walls to thereby permit said mirror to move laterally along said floor;

a counter-abutment member located at the other of said planar surfaces such that said mirror is positioned between said counter-abutment member and said floor; and a fastening mechanism attached to said package, said fastening mechanism extending over said recess from said package to said counter-abutment member, with said fastening mechanism restricting movement of said counter-abutment member relative to said package so that said mirror is retained in place between said counter-abutment member and said floor.

7. A mirror package as set forth in claim 6, wherein said mirror comprises an unframed mirror.

8. A mirror package as set forth in claim 6, further comprising a support member, wherein said mirror comprises a framed mirror that includes a frame extending about its periphery and wherein said mirror is supported by said floor about its periphery via said frame and is supported by said floor at said central region via said support member.

9. A mirror package as set forth in claim 6, wherein said fastening mechanism comprises straps or ties connected to said package and spanning said recess in contact with said counter-abutment member.

* * * * *